US007694630B2

(12) United States Patent
Straub et al.

(10) Patent No.: US 7,694,630 B2
(45) Date of Patent: Apr. 13, 2010

(54) RAILWAY MAINTENANCE VEHICLE WITH BALANCED BULK STORAGE

(75) Inventors: William D. Straub, Franklin, WI (US); Donald C. Noll, Brookfield, WI (US); John K. Luvaas, Mequon, WI (US)

(73) Assignee: Nordco, Inc., Oak Creek, WI (US)

( * ) Notice: Subject to any disclaimer, the term of this patent is extended or adjusted under 35 U.S.C. 154(b) by 650 days.

(21) Appl. No.: 11/207,701

(22) Filed: Aug. 18, 2005

(65) Prior Publication Data

US 2007/0039509 A1 Feb. 22, 2007

(51) Int. Cl.
*E01B 29/00* (2006.01)

(52) U.S. Cl. ..... 104/5

(58) Field of Classification Search ..... 104/2, 104/4, 5, 8, 17.1, 17.2

See application file for complete search history.

(56) References Cited

U.S. PATENT DOCUMENTS

| | | | | |
|---|---|---|---|---|
| 4,373,856 | A * | 2/1983 | Taylor | 414/470 |
| 4,905,608 | A | 3/1990 | Terlecky et al. | |
| 5,615,615 | A | 4/1997 | Theurer et al. | |
| 5,615,990 | A | 4/1997 | Grieshop | |
| 6,021,719 | A * | 2/2000 | Kershaw, Jr. | 105/72.2 |
| 6,155,175 | A * | 12/2000 | Rude et al. | 104/17.1 |
| 2004/0163567 | A1 | 8/2004 | Eldridge et al. | |

* cited by examiner

*Primary Examiner*—S. Joseph Morano
*Assistant Examiner*—Robert J McCarry, Jr.
(74) *Attorney, Agent, or Firm*—Greer, Burns & Crain, Ltd.

(57) ABSTRACT

A railway vehicle movable on a railroad track having a frame configured for movement relative to the track is provided. The vehicle includes a bulk storage container disposed on the frame and located generally at the center of gravity of the vehicle.

6 Claims, 4 Drawing Sheets

RAILWAY MAINTENANCE VEHICLE WITH BALANCED BULK STORAGE

BACKGROUND OF THE INVENTION

This application relates generally to railway right of way maintenance equipment of the type used to repair and maintain railroad track. More specifically, the present invention relates to an improved arrangement for balancing railway right of way maintenance devices on the track upon which they are working.

Conventional railroad track consists of a plurality of spaced parallel wooden ties to which are attached a pair of spaced rail tie plates. Each tie plate is configured to rest on the upper surface of the tie and includes holes for receiving spikes or screws, as well as a canted seat or a cradle formation for receiving the bottom of the steel rail. Since two rails make up a railroad track, there are a pair of spaced tie plates on each tie. Some of the spikes are used to secure the tie plate on the tie and others are used to secure the base of the rail to the tie plate cradle. Anchors are used to prevent linear movement of the rails relative to the ties.

Over time, components of the railroad require maintenance, such as removal and replacement of ties, tie plates and anchors, for example. The railway maintenance vehicle typically includes a frame which is either self-propelled or towable along the track, and at least one workhead configured to engage the track to perform the maintenance task. Depending on the type of maintenance being conducted, the vehicle may carry bulk supplies such as ties, tie plates and anchors. Further, the amount of bulk carried by the vehicle may change over the duration of the maintenance, such as by removing replacement track parts from the vehicle and applying them to the track, or by adding expended track parts onto the vehicle. Not only does the weight change on the vehicle, but the center of gravity of the vehicle changes when the weight of the bulk changes.

The center of gravity and the balancing characteristics of the vehicle are particularly important when the maintenance vehicle is to be lifted up off the track, and when the maintenance vehicle is to be turned around on the track. Typically, the workhead assembly is located on one side of maintenance vehicle, and in some cases, the maintenance vehicle must be turned around in order to do the maintenance on the other side of the track.

Rotation is accomplished with a turntable, which is an assembly on the vehicle that lifts the vehicle off the track, rotates the vehicle, and sets the vehicle back down on the track, as is known in the art. The turntable is usually positioned generally centrally on the vehicle. When the vehicle is lifted off the track, the operator typically must pivot the vehicle about a pivot point on the turntable, such as by manually pushing or pulling on the vehicle about the turntable. Thus, a balanced maintenance vehicle is important for the cylinder to lift the maintenance vehicle off of the track, with no portion of the vehicle touching the track and/or ground. Further, a balanced maintenance vehicle is important for the operator to be able to more steadily and more effortlessly turn the vehicle around on the turntable. Further, a balanced maintenance vehicle more positively retains the turntable and the maintenance vehicle to the track.

Thus, there is a need for an improved railway maintenance machine for balancing the machine on the track.

There is also a need for an improved railway maintenance machine which can be more steadily and more effortlessly turned around on the turntable by a single operator.

SUMMARY OF THE INVENTION

The above-identified needs are met or exceeded by the present railway vehicle that is movable on a railroad track. The vehicle has a frame configured for movement relative to the track and a bulk storage container disposed on the frame and located generally at the center of gravity of the vehicle.

In another embodiment, a railway vehicle movable on a railroad track is provided having a frame configured for movement relative to the track. A bulk storage container and a turntable assembly are disposed on the frame generally at the center of gravity of the vehicle.

Also provided is a railway vehicle movable on a railroad track and having a frame configured for movement relative to the track. The frame has at least two axles. A bulk storage container disposed on the frame is located entirely between the axles.

DETAILED DESCRIPTION OF THE INVENTION

Figure 1:
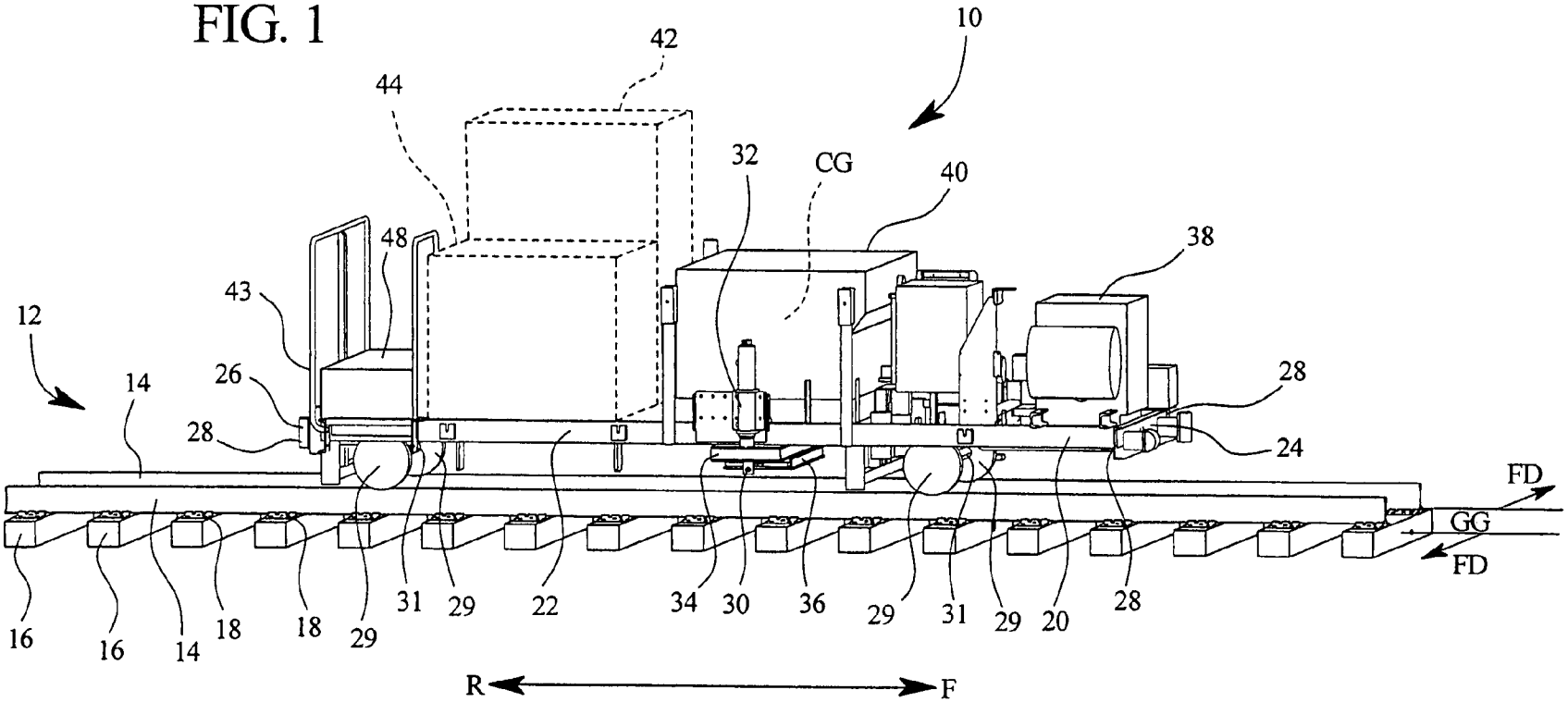
FIG. 1 is a perspective elevation of a railway maintenance apparatus featuring one embodiment of the present centering system.

Referring now to FIG. 1, a railroad maintenance vehicle is generally designated 10, and is specifically designed for applying railway anchors (not shown) onto the track 12. In particular, the railroad maintenance vehicle 10 is designed for applying anchors onto railroad rails 14 to secure rail ties 16 and rail tie plates 18 to the rails and prevent linear movement of the rails relative to the ties. The construction and operation of the railroad maintenance vehicle 10 is described in greater detail in commonly assigned U.S. Pat. No. 7,647,871, entitled RAILWAY ANCHOR APPLICATOR, and commonly assigned, co-pending U.S. Publication No. US-2007-0039511-A1, entitled RAILWAY ANCHOR APPLICATOR MAGAZINE, which is incorporated by reference. However, it is contemplated that other types of rail maintenance equipment may serve as the vehicle 10, including, but not limited to spike pullers and drivers, clip applicators and removers, tie extractors and inserters, tie plate handlers, tie drills, rail adzers, and other such well-known rail maintenance equipment. Further, it is contemplated that any railway maintenance vehicle may serve as the vehicle 10.

The track 12 is made up of a pair of spaced rails 14, which are secured to the plurality of spaced, parallel ties 16 by the plurality of tie plates 18. As is well known, the ties 16 are typically wood, but are also made of concrete in some applications. As is known in the art, the tie plates 18 are secured to the ties 16 by spikes or threaded fasteners.

For purposes of discussion, the forward direction "F" is towards the direction of travel, and the rearward direction "R" is away from the direction of travel. Also, the gage side "GG" of the track 12 is between the rails 14, while the field side "FD" is outside of each rail 14. The length of the vehicle 10 is measured along the track 12, and the width of the vehicle is measured across the track.

The maintenance vehicle 10 includes a main frame 20 configured for movement relative to the track 12 and provided with a pair of generally parallel side members 22, a front end member 24 and a rear end member 26, which are connected at respective corners 28 to preferably form a square or rectangular frame shape. However, it is contemplated that the shape of the frame 20 may vary to suit the application, and each member may be made from one or more components. Rail wheels 29 are preferably rotatably mounted to the frame 20 on axles 31. The axles 31 are generally near each corner 28 to enable the frame to move along the track 12.

Preferably disposed generally centrally on the frame 20 is a turntable assembly 30, as is known in the art. The turntable assembly 30 incorporates a lifting assembly 32, typically one or more fluid power cylinders, such as a single-acting or plurality-acting cylinder, any other equivalent cylinder, or any other lifting assembly known in the art, which is configured to vertically reciprocate the frame 20 relative to the track 12. The turntable assembly 30 also incorporates a pivot assembly 34 configured to pivot the frame 20 from a first direction to a second direction preferably 180-degrees from the first direction, however any amount of rotation can be accomplished. The pivot assembly 34 is preferably a stationary structure with respect to the vehicle 10, but rotates on a pivot point 35 to pivot with respect to the track 12.

The turntable assembly 30 also includes a platform 36 configured for engaging the track 12, preferably by resting on the rails 14 or the ties 16 between the rails. The platform 36 is connected to the pivot assembly 34 at the pivot point 35. When the pivot assembly 34 pivots, the vehicle 10 pivots with respect to the platform 36. Preferably, the turntable assembly 30 is substantially located between the axles 31, and more preferably, the assembly is entirely located between the axles. It is also contemplated that the turntable assembly 30 is not disposed on the frame 20 but is a separate structure placed under and attached to the railroad maintenance vehicle 10.

Figure 2:
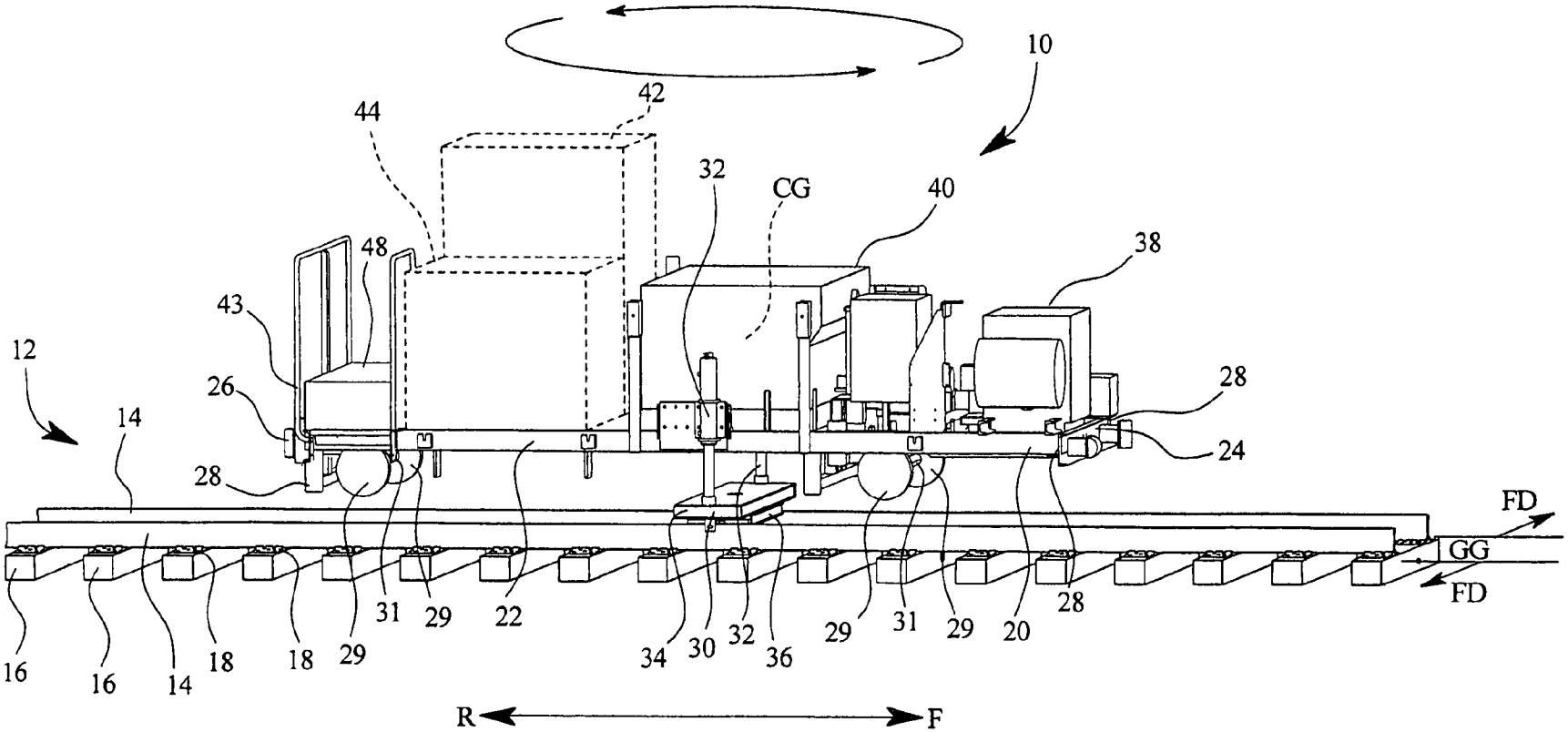
FIG. 2 is a perspective elevation view of the apparatus of FIG. 1 elevated on a turntable.
Figure 3:
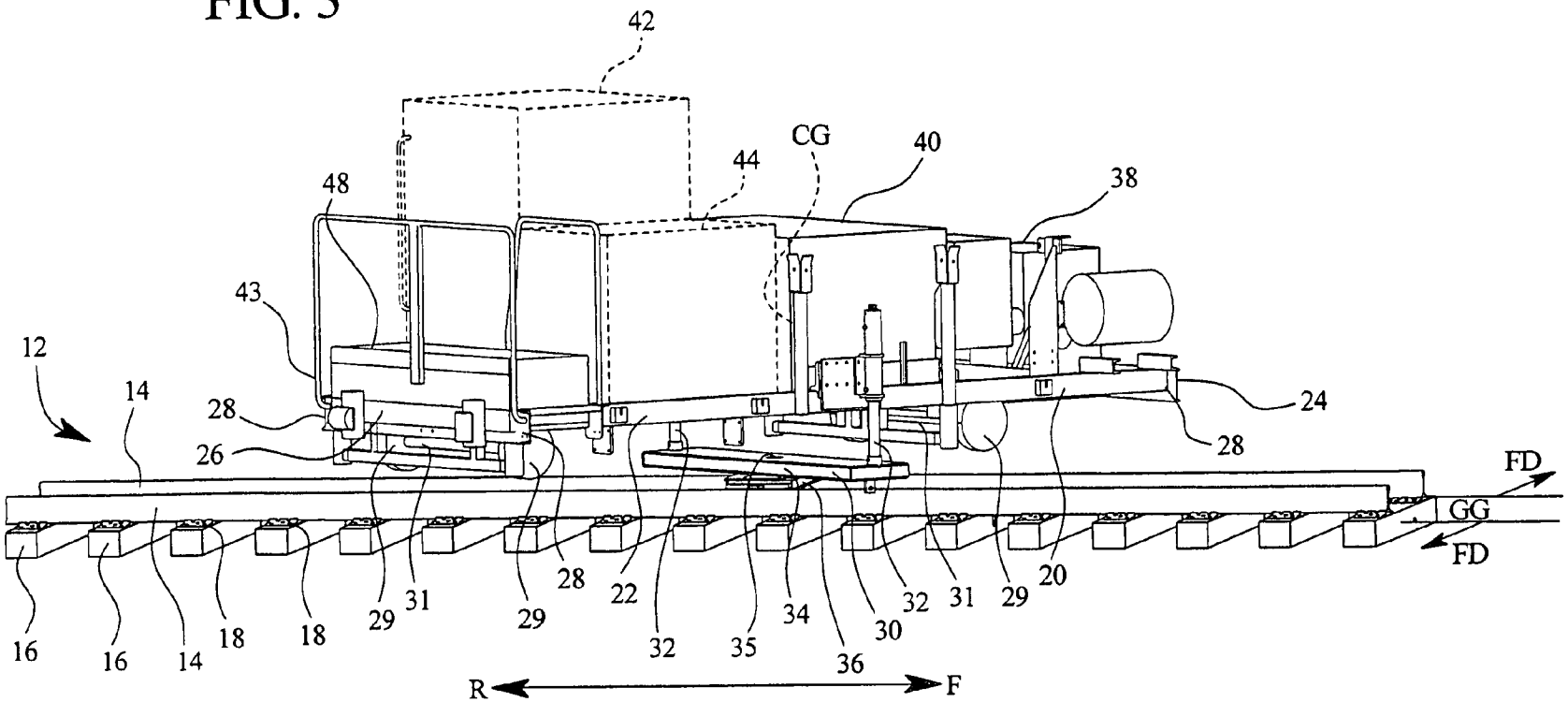
FIG. 3 is a perspective elevation view of the apparatus of FIG. 1 rotated on the turntable.
Figure 4:
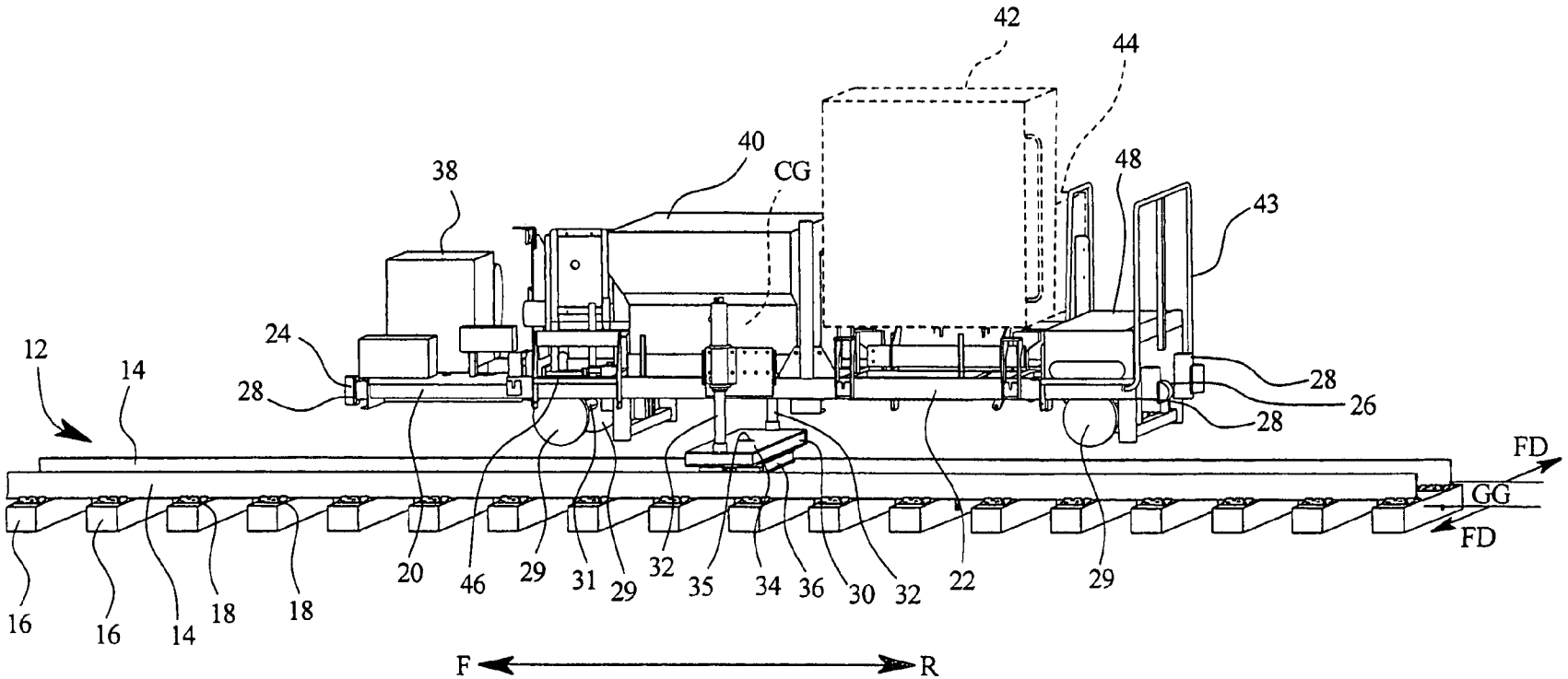
FIG. 4 is perspective elevation view of the apparatus of FIG. 1 rotated 180-degrees on the turntable.

Referring now to FIGS. 1-4, the railroad maintenance vehicle 10 is depicted in a first position in FIG. 1, and the turntable assembly 30 is retracted. This is the position employed when the vehicle 10 is performing rail maintenance or is moving along the track 12. In FIG. 2, the lifting assembly 32 extends so that the platform 36 engages the track 12, lifting the railroad maintenance vehicle 10 off of the track. Due to the preferred location of the turntable assembly 30, described in more detail below, the vehicle is balanced in the elevated position. In FIG. 3, the railroad maintenance vehicle 10 is pivoted on the pivot assembly 34, preferably by at least one operator (not shown) manually pushing or pulling the vehicle around. When the railroad maintenance vehicle 10 is pivoted to the second position in FIG. 4, the lifting assembly 32 can retract to place the vehicle back on the track 12.

Referring back to FIG. 1, an engine 38 is preferably located at the front of the vehicle 10 (in the direction of movement). Disposed generally at the center of gravity of the vehicle 10, a bulk storage container 40 is configured to receive and store bulk supplies, such as anchors, tie plates, etc. In anchor application maintenance, for example, the bulk includes the anchors to be applied to the rail 14, and the amount of bulk stored in the bulk storage container 40 decreases as the bulk is removed from the container and applied to the rail. Preferably disposed behind the bulk storage container 40 (in the direction of travel of FIG. 1) is an operator's station 42 (shown in phantom). Preferably, the bulk storage container 40 is substantially located between the axles 31, and more preferably, the container is entirely located between the axles.

However, in the prior art rail maintenance vehicles, the bulk storage container 40 is located at the rear end 43 of the vehicle 10, and the operator's station 42 is disposed in front of the bulk storage container. The consistent location of the bulk storage container 40 at the rear end 43 of the vehicle 10 in the prior art is due to the way that bulk has been loaded onto the vehicle. Loading of bulk has conventionally been accomplished through use of a boom, where the loading machinery is positioned adjacent the rear of the vehicle to ensure precision of loading. Also, care should be taken to avoid damaging operational components of the particular maintenance vehicle while loading. With new loading methods, such as magnet loading, the precision of loading has improved, which permits the relocation of the container 40 in the present vehicle 10.

Another reason bulk storage containers 40 have been located at the rear of the vehicle is so the bulk does not interfere with the operator's visibility in direction of travel. Although this prior configuration provides the operator with good visibility in the direction of travel, it puts a lot of weight towards the rear end 43 of the vehicle 10, and the center of gravity of the vehicle is shifted towards the rear. When the center of gravity is shifted away from the location of the turntable assembly 30, there is an additional loading on the turntable assembly in the form of torque. In the prior art, this additional loading can be too heavy for the turntable assembly 30, and the bulk is unloaded until the turntable assembly can be operated. Alternatively, this problem is solved by using a larger turntable assembly 30 having a greater maximum loading capacity. However, incorporating a larger turntable assembly 30 entails additional production costs.

Another problem in prior art rail maintenance vehicles with having the bulk storage container 40 at or near the rear end 43 of the vehicle 10 (while the turntable assembly 30 is located generally centrally) is increased stress loading on the frame 20. Thus, in the prior art, the frame 20 of the vehicle 10 had to be strengthened to accommodate such loading, also requiring more materials and higher production and assembly costs.

In the present vehicle 10, the bulk storage container 40 is generally located at the center of gravity CG of the vehicle 10. More preferably, both the turntable assembly 30 and bulk storage container 40 are generally located at the center of gravity CG of the vehicle 10 since this is the most balanced and stable configuration when the vehicle is lifted and rotated. In the most preferred embodiment, both the turntable assembly 30 and the bulk storage container 40 are located at the center of gravity CG. Since the location of the turntable assembly 30 is fixed in place and/or constrained by other machinery on the vehicle 10, it cannot be moved every time the center of gravity changes due to an increase or decrease of bulk loading. Therefore, preferably both the bulk storage container 40 and the turntable assembly 30 have a fixed location at the center of gravity of the vehicle 10, and the decrease and/or increase of bulk in the bulk storage container 40 will generally not affect the location of the center of gravity of the vehicle in the forward or rearward directions.

Preferably adjacent the operator's station 42 is a workhead assembly 44 (shown in phantom) for performing the maintenance on the track 12, such as pulling and driving spikes, applying and removing clips, and extracting and inserting ties, as is well known in the art. More preferably, the workhead assembly 44 is located adjacent the operator's station 42 and rearward of the bulk storage container 40. When required by the workhead assembly 44, bulk is transported to the operator's station 42, such as with a conveyer machine (not shown). The bulk is received at the operator's station 42, preferably at a forward location of the station, and the operator manually feeds the bulk to the workhead assembly 44, preferably at a side location of the station.

The operator's station 42 is configured for one operator to retrieve the bulk and then feed it to the workhead assembly 44. In the preferred embodiment, the workhead assembly 44 and the bulk storage container 40 are 90-degrees apart from each other with respect to the operator's station 42. In this configuration, the operator's range of motion in retrieving the bulk and then feeding it to the workhead is generally 90-degrees or less. In addition, the operator can face in the forward direction. In contrast, in the prior art, the operator would have to face forward when moving the vehicle 10 down the track, face backward to retrieve the bulk from the rear, and turn to the side to feed the workhead assembly 44. It is also contemplated that more than one operator can work inside the operator's station 42.

To initially load the bulk into the bulk storage container 40, a loading platform 46 (FIG. 4) is preferably disposed adjacent to the bulk storage container, however other locations on the vehicle 10 are contemplated. The loading platform 46 is configured for the operator to stand on the platform and direct the bulk from a bulk dispenser (not shown), such as a boom, a crane, or preferably a magnet loader, into the bulk storage container 40. In the preferred embodiment, the loading platform 46 is disposed on the frame 20 and located generally forward of said bulk storage container 40 in the direction of travel.

A walkway platform 48 is disposed on the frame 20 adjacent and preferably rearward of the operator's station 42. The walkway platform 48 preferably has a length that is substantially the same as the width of the vehicle 10, and permits the ingress and egress of the operator from the operator's station 42 to and from both field sides of the track. In this configuration, the operator can exit the operator's station 42 and exit the vehicle 10 from either side of the track 12. Further, since the walkway platform 48 is preferably disposed at the rearward end 43 of the vehicle 10, egress off the rearward end of the vehicle is possible. Also, the ingress and egress of the operator is spatially removed from the workhead assembly 44, the engine 38, the turntable assembly 30 and the bulk storage container 40.

While a particular embodiment of the present railroad maintenance vehicle 10 having a bulk storage container 40 at the center of gravity has been disclosed herein, it will be appreciated by those skilled in the art that changes and modifications may be made thereto without departing from the invention in its broader aspects and as set forth in the following claims.

The invention claimed is:

1. A railway maintenance vehicle movable on a railroad track comprising:

a main vehicle frame extending at least the distance between a front axle and a rear axle of the vehicle, the main vehicle frame supporting the railway maintenance vehicle and providing movement of the vehicle along and relative to the track;

at least one workhead assembly disposed on said main vehicle frame; and a bulk storage container configured for receiving bulk and disposed on said main vehicle frame and located entirely between said front axle and said rear axle, wherein said main vehicle frame is rotatable on the track with a turntable assembly disposed on said main vehicle frame between said front axle and said rear axle to rotate the railway maintenance vehicle relative to the track and to adjust the position of said at least one workhead relative to the track regardless of the amount of bulk in said bulk storage container.

2. The vehicle of claim 1 wherein said workhead assembly is located towards a rear end of said vehicle from said bulk storage container.

3. The vehicle of claim 1 further comprising an operator's station disposed on said main vehicle frame and located towards a rear end of said vehicle from said bulk storage container.

4. The vehicle of claim 3 further comprising a walkway platform disposed adjacent said operator's station, wherein the length of said walkway platform is generally the same as the width of said vehicle, and said walkway platform permits the ingress and egress of said operator's station from both field sides of the track.

5. The vehicle of claim 1 wherein said turntable assembly is located generally between said front axle and said rear axle, wherein said turntable assembly has a lifting assembly to reciprocally move said vehicle vertically relative to the railroad track and a pivot assembly to rotate said vehicle from a first direction of travel to a second direction of travel.

6. The vehicle of claim 5 wherein said turntable assembly and said bulk storage container are generally aligned along the length of the vehicle.

* * * * *